United States Patent [19]

Mueller

[11] Patent Number: 5,070,636

[45] Date of Patent: Dec. 10, 1991

[54] GUN SIGHTING DEVICE

[76] Inventor: Evan Mueller, 305 S. D St., Livingston, Mont. 59047

[21] Appl. No.: 553,737

[22] Filed: Jul. 13, 1990

[51] Int. Cl.[5] ..... F41A 23/16

[52] U.S. Cl. ..... 42/94; 73/167

[58] Field of Search ..... 42/94; 73/167; 89/37.04

[56] References Cited

U.S. PATENT DOCUMENTS

| | | | |
|---|---|---|---|
| 577,026 | 2/1897 | Heinrich | 89/37.04 |
| 1,042,357 | 10/1912 | Livtschak | 89/37.04 |
| 4,055,017 | 10/1977 | Thompson | 42/94 |
| 4,207,699 | 6/1980 | Hensley | 42/94 |
| 4,333,385 | 6/1982 | Culver | 89/37.04 |
| 4,913,391 | 4/1990 | Klipp | 42/94 |
| 4,972,619 | 11/1990 | Eckert | 42/94 |

FOREIGN PATENT DOCUMENTS

| | | | |
|---|---|---|---|
| 301707 | 1/1920 | Fed. Rep. of Germany | 89/37.04 |
| 3204082 | 8/1983 | Fed. Rep. of Germany | 42/94 |

OTHER PUBLICATIONS

"Kind Shooting Rest", The American Rifleman, Jan. 1960, pp. 56–57.

*Primary Examiner*—Stephen C. Bentley
*Attorney, Agent, or Firm*—Douglas L. Tschida

[57] ABSTRACT

A weapon sighting assembly including a longitudinally extending frame which is rotatively secured under tension about a shock plate means which couples the assembly to a grounded support. A resiliently supported barrel rest is adjustably mounted along the longitudinal frame. A weapon receiving cradle includes a compressive, elastomeric pad and surfaces conforming to the aft end of the weapon and the marksperson's hand and/or shoulder. Cant adjustment means are provided at the shock plate, windage adjustment means couple to the longitudinal frame and a resilient strap can be used to further couple a weapon to the assembly.

20 Claims, 8 Drawing Sheets

GUN SIGHTING DEVICE

BACKGROUND OF THE INVENTION

This invention relates to a gun sighting device and more particularly to a portable device to sight a revolver or rifle which can be used with a conventional table or bench, a stump or my new portable bench.

Whenever hunters, marksmen or users of firearms use a gun, the sights need to be aligned relative to the weapon to assure the accuracy of the weapon. Preferably the sights are adjusted independent of the shooter. Later detected inaccuracies can then be directed to correcting deficiencies in the shooter's form or technique or the weapon can be compensated for the shooter in a known manner and not by mere guess.

Many devices have been proposed to hold a gun aimed at a fixed target position while aligning the sights. Some of the least complex comprise sand bags or other passive support structures. Another more complex structure can be found in U.S. Pat. No. 3,358,504 to Freebairn, which illustrates a sighting device that uses a ground tripod to support the sighting device. This device has a number of complicated clamps and adjustments to hold the rifle in position relative to the tripod and to align the rifle with a target. A pneumatic or hydraulic shock absorber is used to absorb the shock when the gun is fired.

U.S. Pat. No. 3,805,608 to Schmidt et al. and U.S. Pat. No. 4,333,385 to Culver illustrate smaller, more compact, gun sighting devices which can be fixedly mounted to a bench. With these devices, the bench itself must be turned to roughly align the gun barrel with the target before any final adjustments can be made. In Culver, the shock absorber is a resilient cushion. In Schmidt, the shock absorber is a spring. U.S. Pat. No. 4,621,563 describes an aligning device which fixedly mounts to a bench, but which device may pivot relative to the fixed base. This device includes springs fixed between the base and the gun receiving member to absorb shock when the gun is fired.

SUMMARY OF INVENTION

It is accordingly a primary object of the invention to provide a portable weapon support which is mountable to an ordinary bench or table, usable to resiliently support the weapon and capable of absorbing recoil shock when the weapon is fired and/or transferring the shock to the bench or table.

It is a further object of the invention to provide a sighting device which is adjustable to fit different weapon lengths, fore-stocks, shoulder stocks and/or hand grips and capable of roughly aligning the weapon with the target, before fine adjustments are made, without the necessity of moving the bench or table to orient the weapon to the target. This is especially important where the bench or table is secured to the ground or floor.

It is a further object of the invention to secure the weapon to the device at multiple resilient points of contact without clamps.

It is a further object of the invention to permit vernier adjustments of the weapon's alignment during the sighting process.

It is a still further object of the invention to provide an assembly which may be used in the fashion of a bench clamp to support a weapon in an upright manner while being worked upon.

Various of the foregoing objects and advantages are achieved in the present invention which provides a sighting device that includes a longitudinal base having a barrel/fore-stock support rest and a shoulder stock/-hand grip cradle. Multiple, resilient recoil transfer mechanisms are provided for absorbing recoil forces of the supported weapon and/or transferring the forces from the sighting device to the bench or grounded support.

The base is resiliently securable to the table or bench via a shock mounting plate which includes an intermediate, adjustable spring biased tensioner. A pivot axle projecting from the shock plate facilitates movement of a longitudinal frame portion. Rotational adjustment capabilities of the frame particularly permit coarse horizontal adjustment of the weapon with the target, eliminating the necessity of having to move the entire bench or table. Associated adjustable feet secured to the ends of the shock mounting plate permit adjustment of weapon cant.

The fore-stock rest is longitudinally and vertically adjustable relative to the base frame with an axle positioned approximately perpendicular to the longitudinal axis of the gun barrel. Longitudinal adjustment capabilities of the rest and/or frame permit the fitting of the rest to the barrel or fore-stock. Mounted to the upper end of the axle is a V-shaped support rest having a press-fit elastomeric contact surface and upon which the fore-end of the weapon rests. The axle is vertically adjustable relative to the base to accommodate fine adjustments for weapon elevation.

The stock or hand grip cradle is shaped to provide a maximum area of surface contact with the stock or hand grip. The curvature is particularly established to do away with the necessity of a movable backplate for accommodating elevation adjustments. The cradle is lined with an elastomer to compressively, resiliently contain the weapon thereto during normal sighting conditions. A spring biased windage or lateral adjustment mechanism secured to the frame and in frictional contact with the table permits fine lateral adjustment of the base relative to the table.

Depending upon a shooter's preference and while positioned in the cradle, a rifle may be normally supported against the shoulder during the sighting process. Similarly a pistol may be held in the hand, while cradled. Alternatively, a supported weapon may merely rest on the present shooting support and be sighted without shooter intervention, except to squeeze the trigger.

As weapon is fired, the framework absorbs the shock through multiple resilient absorption features. Additional shock dampening is achieved by transmitting the forces to the bench or table through the shock plate or the portion of the stock/hand grip cradle contacting the table top.

A resilient and length adjustable elastomer strap secured intermediate the fore-end rest and cradle may, as necessary, be used to contain the weapon to the base.

In order that the invention may be clearly understood and readily carried into effect, various presently preferred constructions are described below, by way of example only, with reference to the appended drawings. To the extent alternative constructions, improvements or modifications may have been considered, they are described as appropriate.

DESCRIPTION OF PREFERRED EMBODIMENTS

Figure 1:
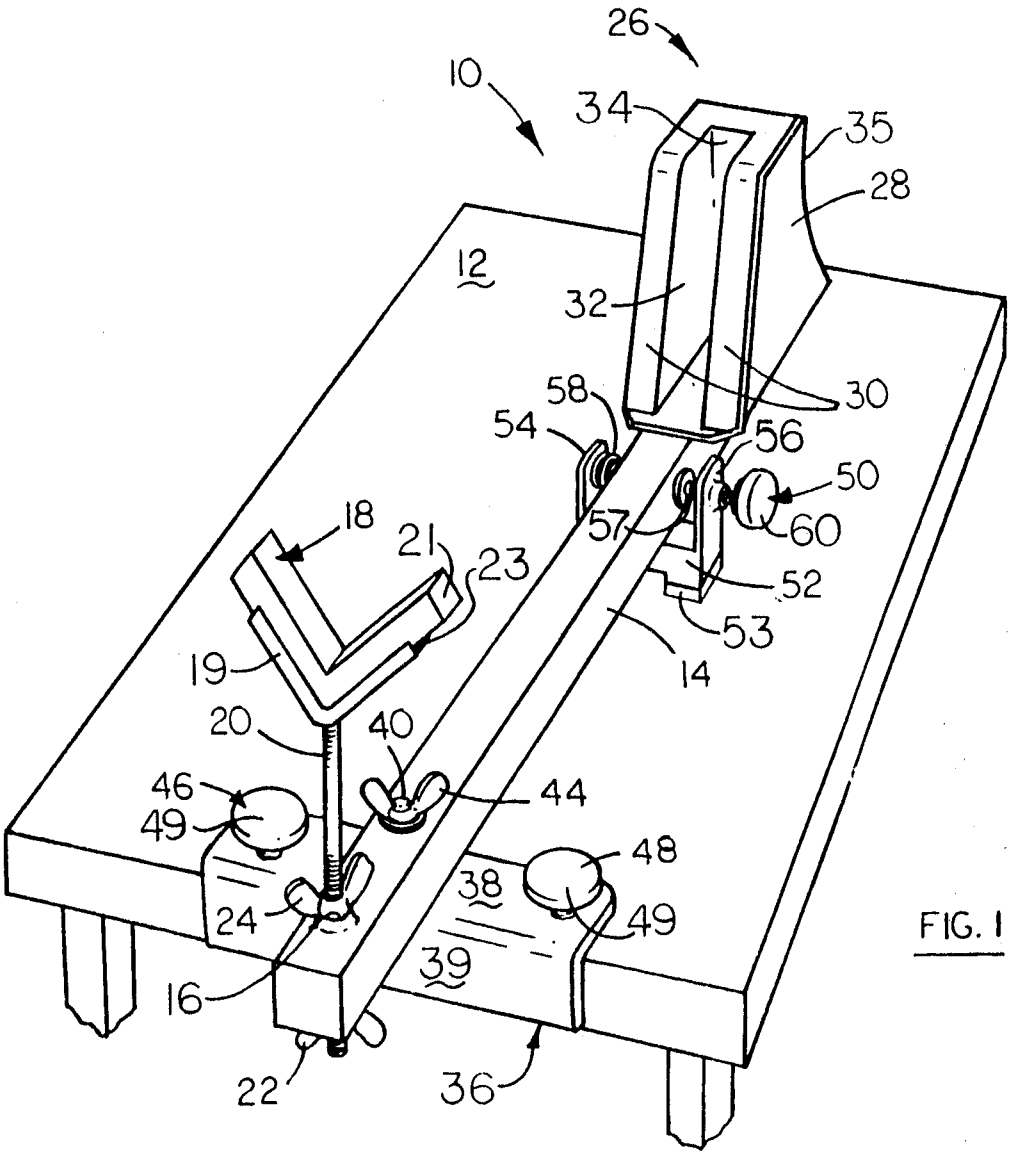
FIG. 1 is a perspective drawing of a rifle sighting assembly embodying the present invention and located on a table top.
Figure 2:
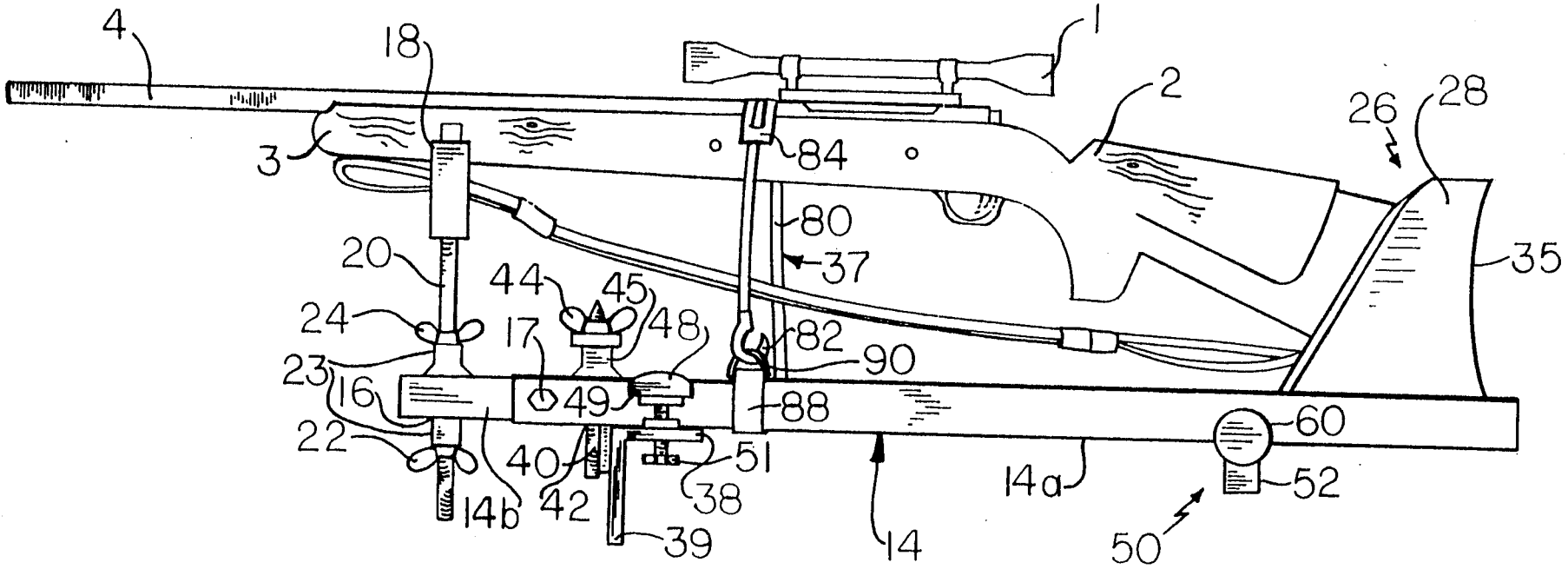
FIG. 2 is a side elevational view of the sighting assembly shown of FIG. 1, with rifle positioned for sighting.
Figure 3:
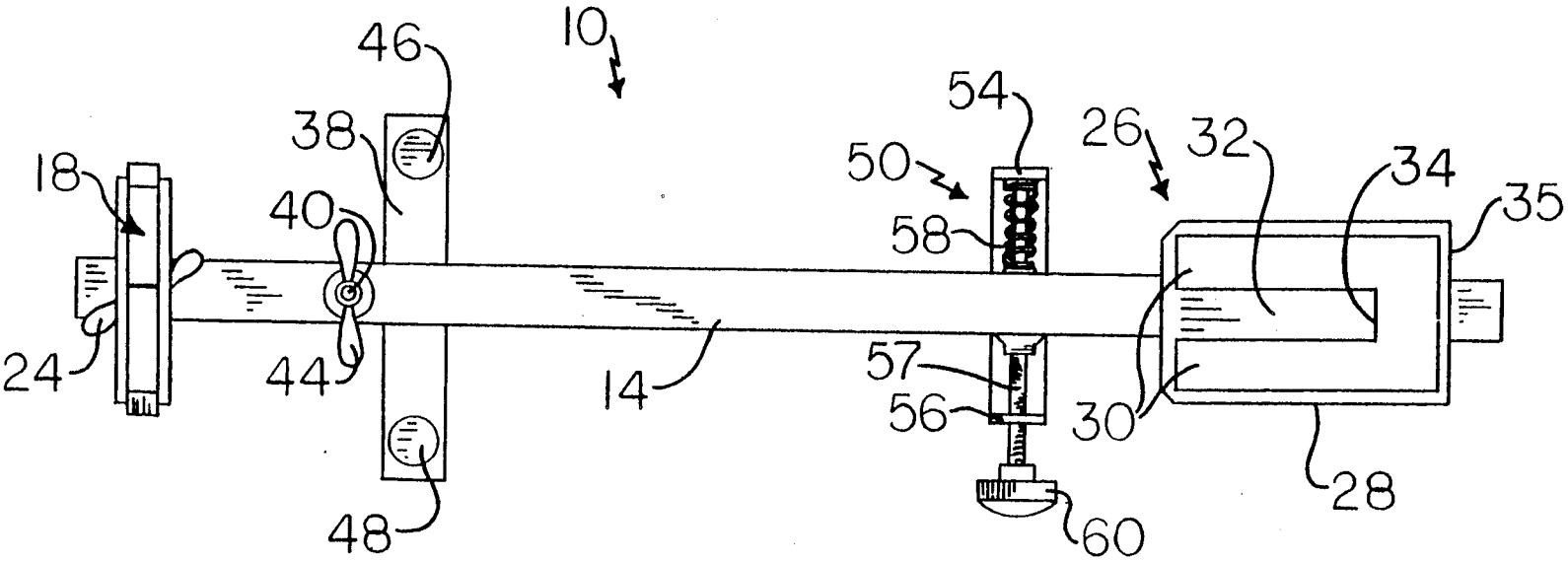
FIG. 3 is a top plan view of the sighting assembly of FIG. 1 with the table and rifle removed.

A construction of the invention in the form of a rifle sighting assembly 10 is shown in FIGS. 1 to 3 and wherefrom FIG. 1 particularly shows the assembly 10 as it is normally positioned on a table 12. The assembly 10 includes an elongate base or frame 14 which can be of fixed length or may include slideably extensible portions 14*a* and 14*b*, such as in the assembly of FIG. 2, and which portions 14*a*, 14*b* are concentrically mounted and secured to one another with a locking fastener 17. The mounting between the portions should be as rigid as possible to minimize vibration. A length adjustable frame 14 facilitates the fitting of the assembly 10 to the barrel or fore-stock of the weapon.

The frame 14 is provided with a transverse bore 16 at its fore-end and wherethrough a barrel rest assembly 18 is adjustably mounted. The assembly 18 includes a threaded stem 20 which is sized to be received at the bore 16. Wing nuts 22 and 24 are threaded on the stem 20 relative (reference FIG. 2) and capture the frame 14 and/or resilient spacers 23 and/or washers to establish the vertical position of the barrel rest 18 above the frame 14. In the presently preferred construction, a flat washer and lock washer combination between the nut 24 and a rigid stand off provide an adjustable tension, whereby the freedom of rotation of the rest 18 is variable.

Figure 4:
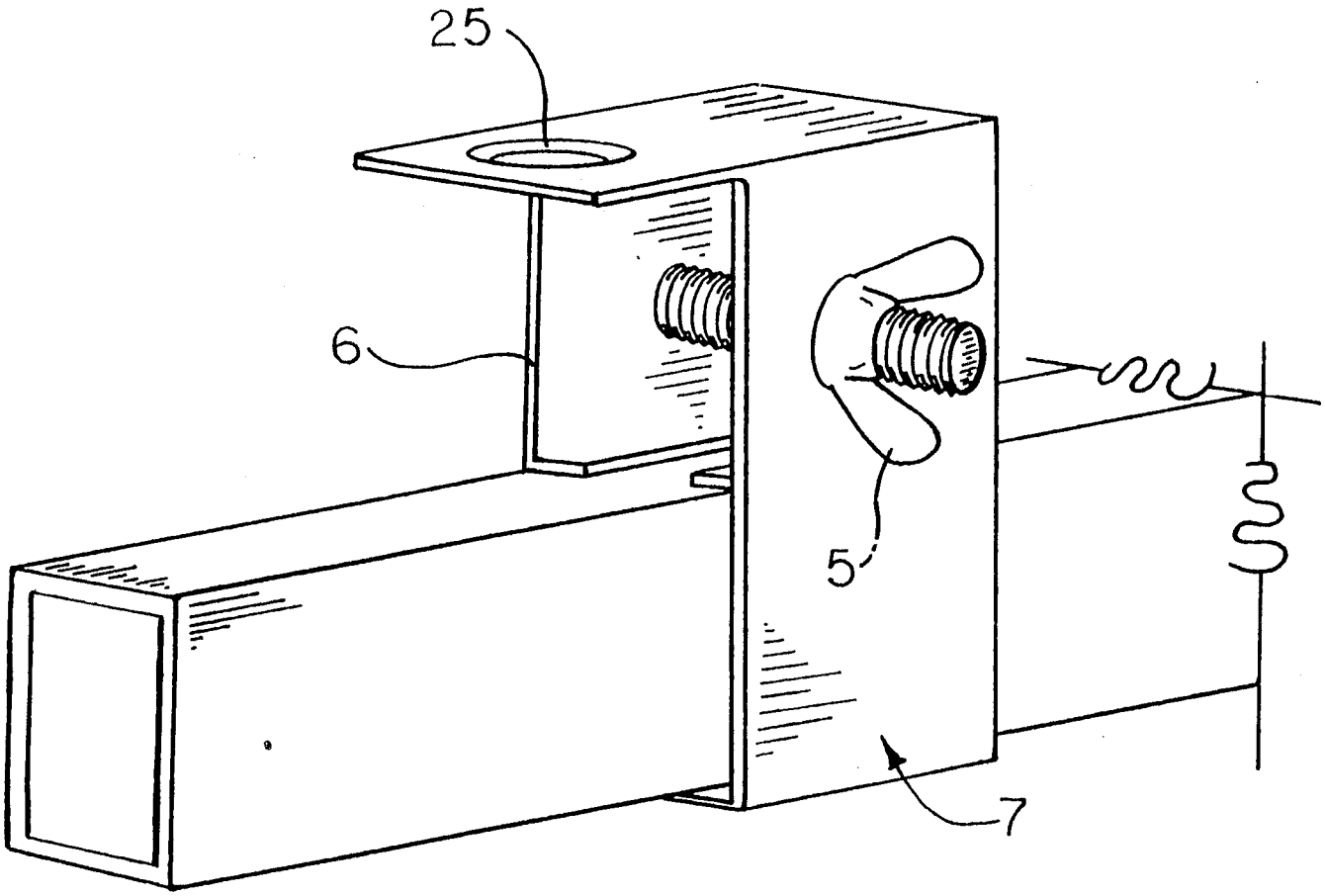
FIG. 4 is a partial isometric drawing of a slide adjuster mechanism for the barrel rest assembly.

A spring or compressible standoff mounted between flat washers in alignment with the bore 16 might be used for the spacers 23. Multiple bores 16 might also be formed along the frame 14 to accommodate rifles 9 with stocks 8 of differing lengths. Alternatively, a slide assembly clamp 7, reference FIG. 4, can be used in combination with a fixed length frame 14. The slide clamp 7 provides a body 6 which concentrically mounts to the frame 14 and a bolt/nut fastener 5 compressively draws the body 6 to the frame 14. A bore 25 sideably, receives the rest assembly 18 in the fashion of the bore 16. The purpose of such adjustment mechanisms, however, is to optimally fit the barrel rest 18 to the fore-stock 3 or barrel 4 in the fashion of the extensible frame of FIG. 2.

With reference to FIG. 2, barrel rest assembly 18 otherwise generally comprises a V-shaped channel member 19 which captures and supports opposite lateral surfaces of the rifle barrel 4 or fore-stock 3 of a rifle 2. The arm spacing or angle of the V member 19 can be varied to accommodate fore-stocks of differing widths. A high density elastomer pad 21, on the order of shoe-sole material, is press fit into a channelway 23 formed in the upper surface of the member 19. The pad thickness or density can be varied to shooter preference. Alone or in combination with the resilient spacers 23, a positive shock absorbing assembly 18 is obtained for the fore-end of the rifle 2.

A stock receiving cradle assembly 26 is fixedly attached with screws or other fasteners to the aft end portion of the frame 14. The cradle 26 is provided with an outer rigid cover 28, which is typically formed from a formed molded aluminum plastic or other composites would also work and which is lined with a foam or elastomeric pad 30 of lesser density than that used for the pad 21. The aft interior surface of the cradle 26 presents a convex surface 34 for receiving the butt plate of the rifle 2. The cavity 32 is sized to securely grip the butt stock of the rifle 2 when the stock is inserted in the cradle 26 as shown in FIG. 2. The pad 30 thereby compressively supports the stock of the rifle 2 to the frame 14 and further cushions the rifle 2 when a shot is fired. The convex interior surface 34 and material resilience also allows the butt of the rifle 2 to rise slightly and/or pivot as the barrel rises, as if shot against a shoulder, yet return to the initial mounting position, which normally is with the butt stock fully seated in the cradle 26. Alternatively, the butt stock could be positioned higher in the cradle 26, which position would be maintainable due to the density of the pad 30.

The aft most surface 35 of the cradle 26 otherwise is curved to conform to a user's shoulder and enable the user to hold the rifle 2 in a normal shooting position. This feature finds application during initial rough sighting, prior to making fine adjustments to either the scope 1 or other adjustment mechanisms of the assembly 10. The support otherwise provided by the elastomer pads 21, 30 and a resilient hold down strap assembly 37 securely restrains the rifle 2 to the assembly 10 without user intervention.

Figure 8:
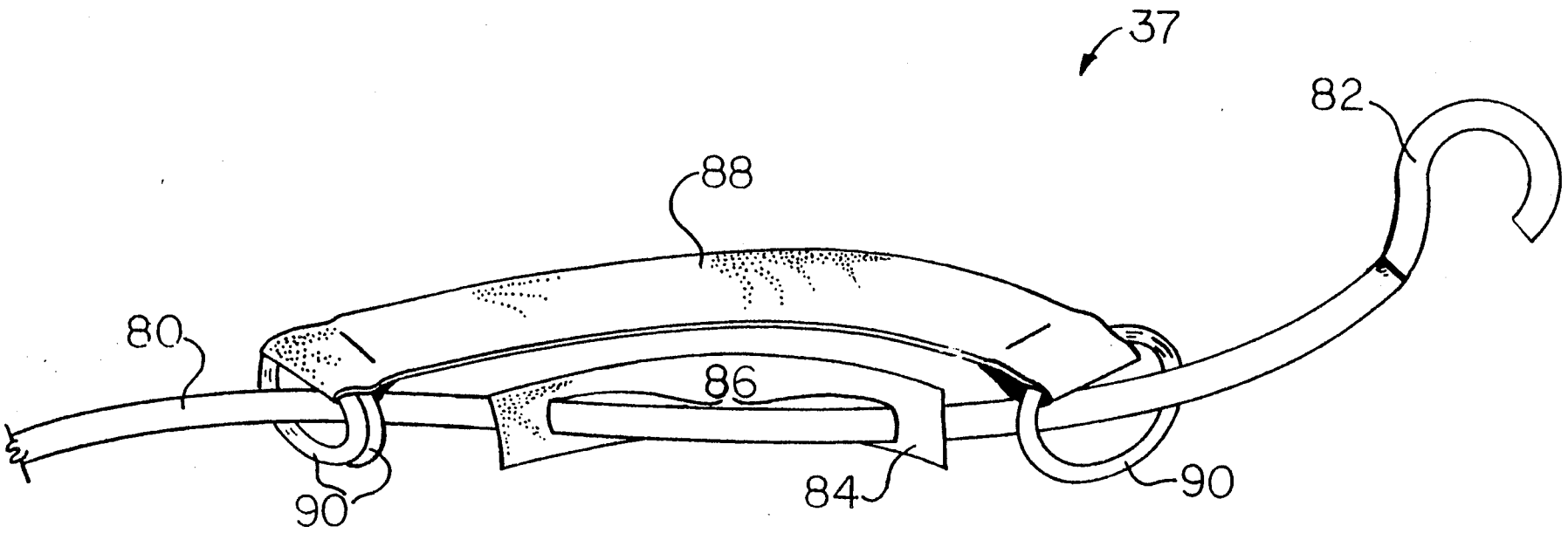
FIG. 8 is an isometric view of a hold down strap.

The strap assembly 37 is particularly shown at FIG. 8 and wherefrom it is to be noted that the strap essentially comprises a length of rubber tubing 80 which includes a hook member 82 secured at one end. The tubing 82 is threadably mounted through a first fabric strap 84 which includes slots 86 at each end. Mounted above the first strap 84 is a second fabric strap 88 which contacts the underside of the frame 14. Hemmed to the depicted right end of the strap 88 is a first D ring member 90 and hemmed to the left end are a pair of D rings 90. When a strap is used, and with additional reference to FIGS. 2 and 5, the strap portion 84 mounts over the top of the weapon, while the strap 88 is secured beneath the frame 14. The hook 82 is secured to the single hook member 90, while the other end of the strap 80 is appropriately looped in a woven fashion through the pair of D rings 90 at the opposite end of the strap 88 to frictionally restrain the strap 88 at a desired length. The resilience within the strap 80, otherwise not only resiliently binds the weapon to the sighting assembly 10, 63, but also restrains the looped tubing 80 to the pair of D rings 90. The use of a strap 37 has not been found to be required with most rifles.

Referring again to FIG. 1, a front shock plate 36 is provided adjacent the forward end of the frame 14. The front shock plate 36 comprises an angle iron member and of which one web 38 is positioned to rest along a top edge surface of the table top 12, while the other web 39 extends downwardly at the edge along one side of the table top as shown in FIG. 2. A threaded shaft 40 is fixedly secured to the front shock plate 36 as by welding and extends upwardly thorough a corresponding bore 42 provided in the frame 14. The bore 42 is sized to slideably receive the threaded shaft 40. A wing nut 44 and resilient locking spacer 45, similar to the spacers 23, are provided on the shaft 40 above base frame 14 and are used to secure the frame 14 under rotational tension at a selected angular position with respect to front shock plate 36. Additional resilient spacers 45 or springs may be positioned beneath the frame 14 to achieve this end. Alternatively, a second wing nut 44 and spacer 45 might be provided beneath the frame 14 in the fashion of the nuts 22, 24 and spacers 23.

Two adjustment screws 46 and 48, which are also shown in FIGS. 2 and 3, are positioned to either side of the rifle 2 along the web 38 and permit correction of the cant of the rifle 2 when it is being sighted. The screws 46, 48 are threadably received by the web 38. A hand wheel or knob 49 at one end of the screws 46, 48 and a pad 51 contacting the table 12 enables the user to raise/-lower the ends of the web 38 relative to the table 12 to tilt or rotate the weapon in a direction dependent upon which cant adjustment screw is being used. Springs may be added as lock washers and/or to provide for further shock absorption.

A side-to-side or windage adjustment mechanism 50 is provided on the frame 14 at a position adjacent the cradle 26. The windage mechanism includes a U-shaped base 52 which includes a friction pad 53 attached to the underside of the base 52 and which rests on the table top 12. Opposing vertical walls 54 and 56 extend upwardly on either side of the frame 14. The sidewall 54 includes a compression spring 58 and the wall 56 includes a threaded stem 57 each of which engage the respective sides of the frame 14 to hold the frame 14 in tension therebetween and as shown in FIG. 3.

By turning a hand wheel 60 of screw 57, the frame 14 can thus be adjusted laterally relative to spring 58. A fine side-to-side adjustment of the frame 14 and supported rifle 2 is thereby obtained relative to prevailing winds. Although the base member 52 frictionally engages the table 12, it is to be appreciated that it could be rigidly fastened to the table 12, such as in the assembly 50 of FIG. 2 which doesn't provide for a friction pad 53.

To use the sighting assembly 10 with a rifle 2 and with reference to FIG. 2, a marksperson places the sighting assembly 10 on the table top 12 with the front shock plate 36 depending downward along one edge of the table top 12 and rough aligns the assembly 10 relative to a target (not shown). The rifle 2 is then positioned with the stock inserted in the cradle 26. The pads 30 frictionally engage the stock to securely hold the stock in the cradle 26. The strap restraint 37 may, in turn, be added to resiliently bind the rifle 2 to the frame 14. Most often the strap is not required.

The adjustment screws 46, 48 are next adjusted to correct any cant in the rifle 2, which is now resting on the sighting assembly 10. The tension on the wing nut 44 is adjusted to provide a desired resistance to rotation of the frame 14 relative to the shock plate 36 and the rifle 2 is held normally with the aft cradle surface 35 resting against the shooter's shoulder. The rifle is rotated so that the sights of the rifle or reticle of the scope 1 is horizontally aligned with the desired target and orientation of the rifle relative to the front shock plate 36. The side-to-side adjustment assembly 50 may also be manipulated to further rotate the frame 14 relative to the shaft 40 to fine align the frame 14.

The shooter next loosens wing nut 24 and screws wing nut 22 in the appropriate direction so that the elevation of the rifle 2 is adjusted relative to the target. When the vertical adjustment has been completed, wing nut 24 is tightened. Further adjustments can be made as necessary in a similar fashion by repeating in an iterative fashion adjustments at the stem 20, shaft 40 or screws 46, 48 or 60 until a desired angular orientation of the rifle 2 with respect to the target is obtained.

Once the sights of the rifle 2 have been aligned with the target, the rifle 2 may be fired. The primary recoil shock forces are transmitted to and through the stock cradle 26 to the frame 14 and then to table 12 through the base 52 of the windage adjustment assembly 50 and front shock plate 36. Secondary recoil at the fore stock is either absorbed by the pad 21 or transmitted to the frame 14 and to the shock plate via the shaft 40. If the sights are not properly adjusted the sights may be adjusted, and the above process repeated until such time as the sights are accurately aligned with the desired target.

Figure 5:
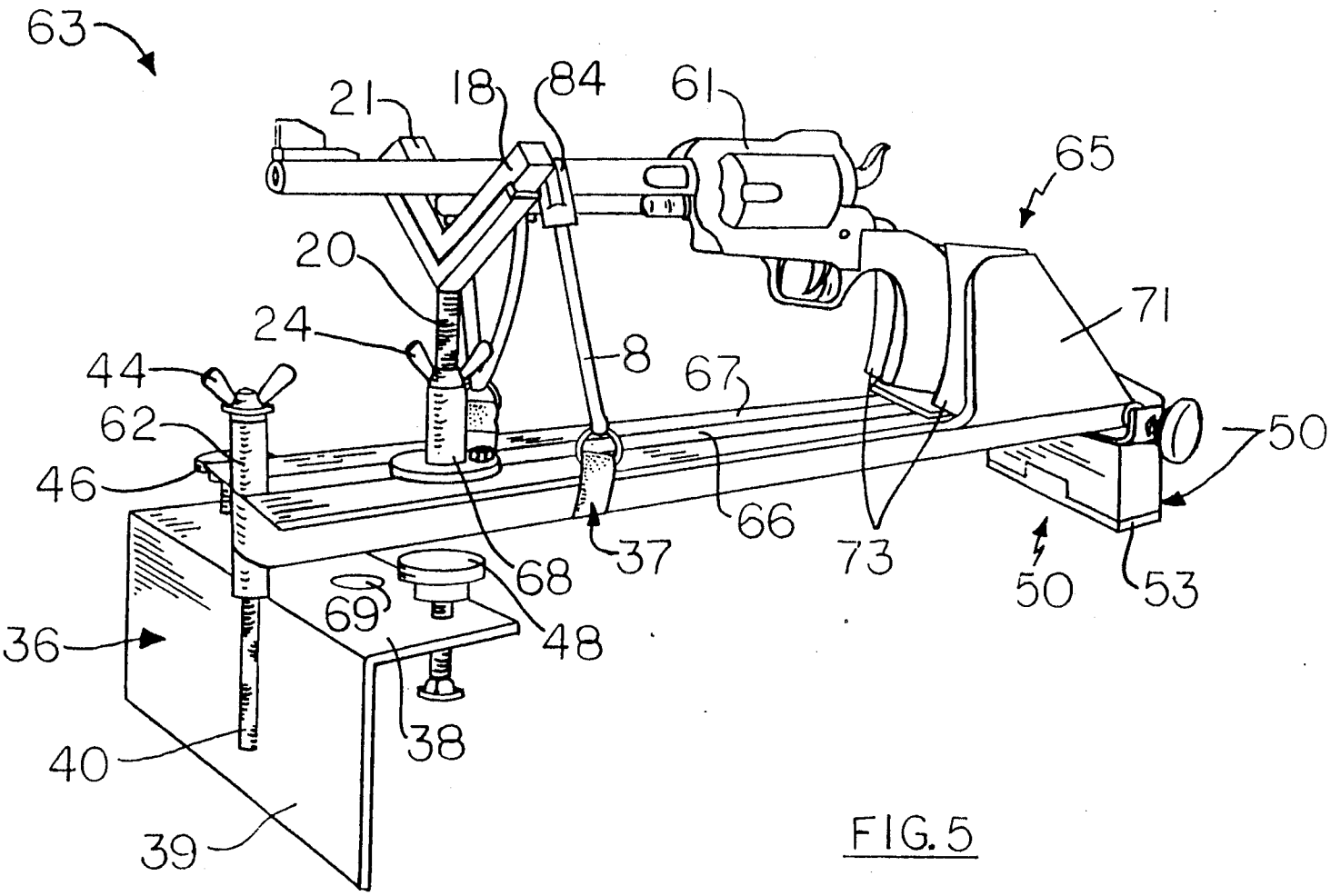
FIG. 5 is a perspective view of a second embodiment of the invention which may be used for sighting a revolver.
Figure 6:
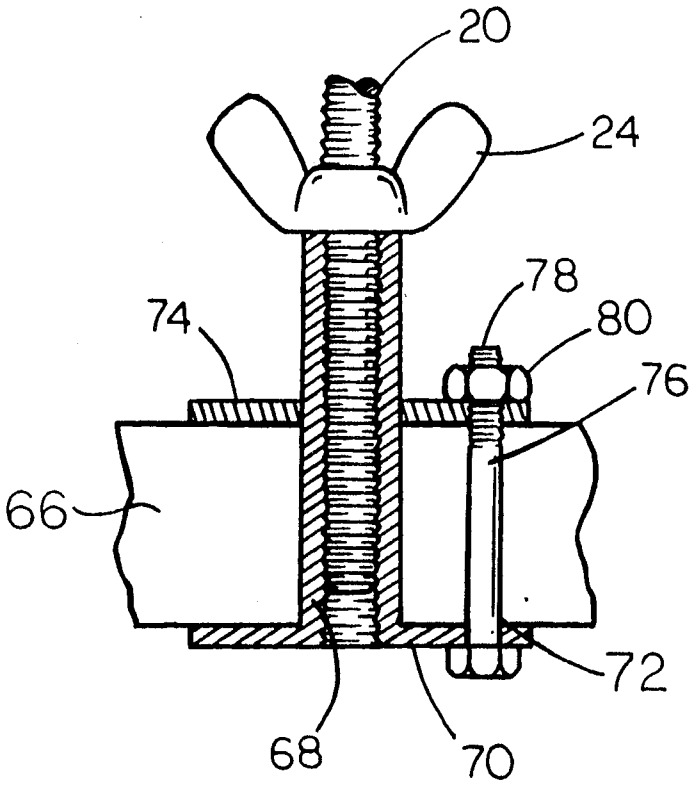
FIG. 6 is a partial cross sectional view taken along section line 6—6 of FIG. 6.
Figure 7:
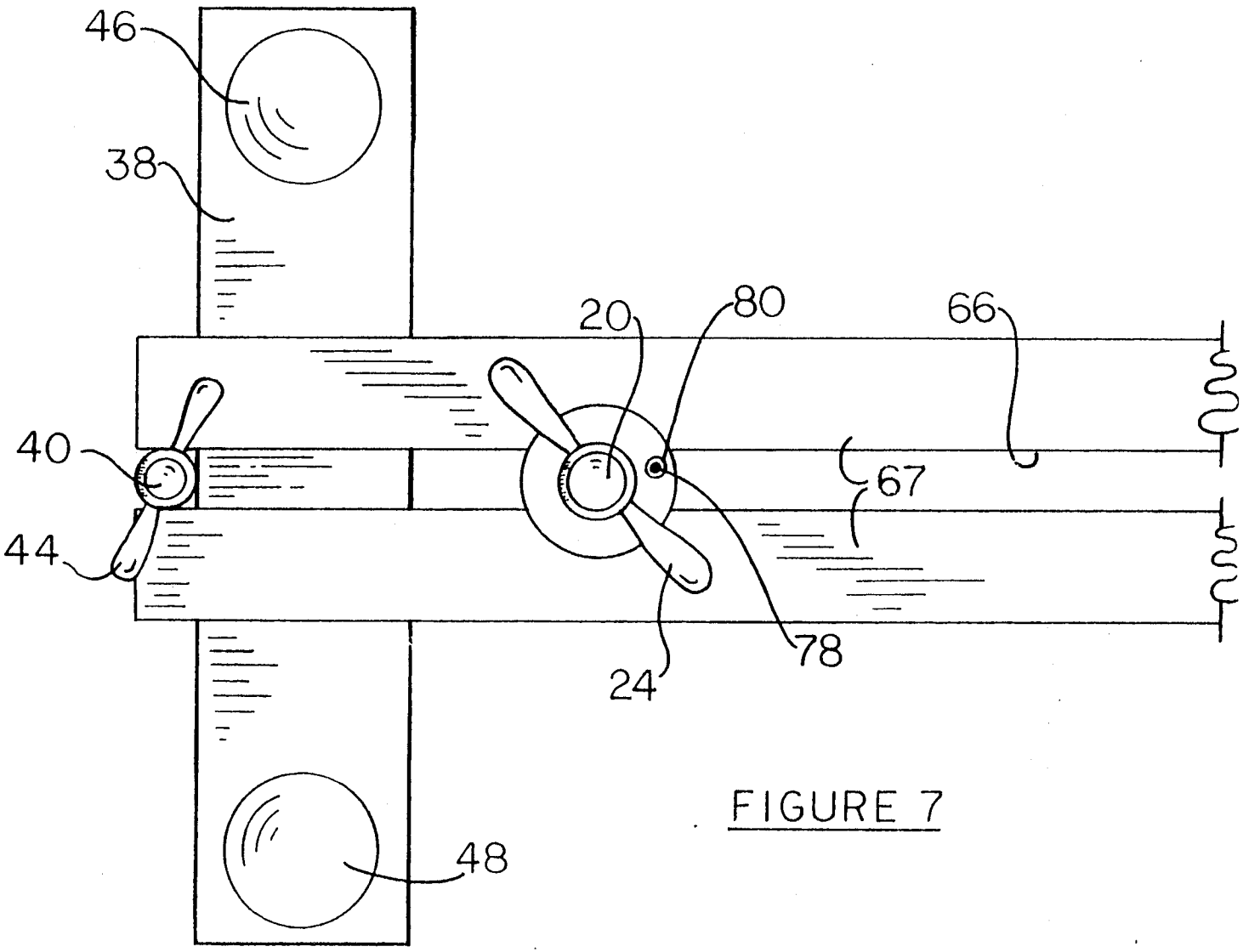
FIG. 7 is a partial cross sectional view taken along section line 7—7 of Figure.

With reference to FIGS. 5 through 7 and in an alternative construction, the sighting assembly 10 has been modified for use in sighting a revolver 61 as particularly shown in the assembly 63 in FIG. 5. For the assembly 63 the barrel rest 18 is moved closer to the hand grip cradle assembly 65 to accommodate the shorter barrel lengths of revolvers. In the fashion of the longitudinal. barrel rest adjuster mechanisms of FIGS. 2 and 4, an elongated slot 66 is formed in the frame 67 to permit a slide adjustment of the barrel rest 18 relative to the hand grip cradle assembly 65 and thereby accommodate revolvers of different barrel lengths.

With additional reference to FIG. 6, the barrel rest assembly 18 is substantially the same as before except that the shaft 20 is threadably mounted in a tubular standoff 68. A lower flange 70, which is rigidly secured to the standoff 68, secures the standoff 68 within the slot 66 and rests against the lower surface of the frame 67. A bore 72 of the flange 70, which is normally aligned with the slot 66, receives a bolt 76 that extends through the slot 66 to align with a bore of a resilient lock washer 74 which mounts about the standoff 68. Upon tightening a nut 80, which is threaded on to bolt 78, the standoff 68 is rigidly secured at a selected position along the slot 66.

Otherwise, a wing nut 24 is, as before, threaded onto stem 20, before stem 20 is inserted into tube 68. Upon appropriately adjusting the exposure length of the stem 20 relative to the standoff 68 and thereby the height of the barrel rest assembly 18 above the frame 67, the wing nut 24 is tightened to lock the exposure length. A resilient hold down strap assembly 37, previously described with respect to FIG. 8, is provided to securely hold the barrel of the revolver 61 against the barrel rest 18 without damaging the revolver finish.

Mounted to the fore-end of the frame 67 is a front shock assembly 36 which again permits adjustments of the revolver cant relative to provided hand knobs 46 and 48. To accommodate the mounting to the frame 67, the stem 40 projects through a sleeve 62 welded to the fore-end of the frame 67. The wing nut 44 and washer secure the stem to the tube 62. As mentioned before, resilient spacers or a spring might be mounted between the frame 67 and the web 38 to provide a resilient connection between the shock plate 36 and frame 67.

A windage or side-to-side adjustment assembly 50 is also mounted to the aft end of the frame 67 and permits a fine, lateral adjustment of the frame 67.

Relative to the hand grip cradle 65, it again is formed to provide a molded housing 71 which includes an elastomeric insert 73 that compressively receives the revolver hand grip. An aft, flat interior surface of the cradle 65, angulating approximately 15 degrees from vertical, butts against the hand grip to restrain the revolver 61 and absorb shock. The aft most end of the cradle 71 is otherwise formed to permit normal grasping of the cradle within the shooter's hand during initial weapon alignment. Thereafter, the shooter can merely sight and manipulate the trigger mechansim without having to hold the revolver 61. The mass and shock absorbing qualities of the assembly 63 otherwise have proven to be such as to absorb all recoil shock as the revolver 61 is fired, without movement of the assembly 63. Should a user be concerned with movement of the assembly 63, through holes 69 are provided in the front shock plate and whereat appropriate fasteners can be used to anchor the shock plate to a table top or other shooting support, such as disclosed in Applicant's copending U.S. application Ser. No. 07/553,738 entitled Collapsible Shooting Stand.

Otherwise, the process of sighting in the revolver 61 is substantially the same as with the rifle 2 described above.

While the fundamental novel features of the invention have been shown and described, it should be understood that still other substitutions, modifications and variations may be made by those skilled in the art without departing from the spirit or scope of the invention. Accordingly, the following claims should be interpreted to include all such modifications or variations.

What is claimed is:

1. Apparatus for adjusting the sights of a weapon having a barrel and a stock comprising:

(a) a base;

(b) means mounted to the base for resiliently supporting the barrel;

(c) stock receiving means including an end wall having a curved interior surface conforming to an aft end shape of the stock and a curved outer surface shape conforming to a region of normal physical support of the stock by a marksperson; and (d) recoil transfer means for absorbing and transferring to a grounded support recoil shock forces acting on the base upon discharge of the weapon, whereby the weapon remains substantially stationary with each weapon discharge.

2. Apparatus as set forth in claim 1 including means coupled to said grounded support for rotational movement of the base about an axis substantially perpendicular a longitudinal axis of the weapon.

3. Apparatus as set forth in claim 2 wherein the apparatus further includes means resting on the grounded support having first and second uprights mounted to opposite sides of the base and including means for rotating the barrel about the perpendicular axis in a plane substantially parallel with the grounded support and means for resiliently supporting the base between the uprights.

4. Apparatus as set forth in claim 1 wherein the recoil transfer means includes a forward frame member shaped to engage an edge surface of the grounded support.

5. Apparatus as set forth in claim 4 wherein the base is rotationally mounted to an axle fixedly projecting form the forward frame member.

6. Apparatus as set forth in claim 1 wherein the stock receiving means further includes bottom and side wall portions and wherein the interior surfaces of at least the side walls are lined with an elastomer, such that upon insertion of a weapon the elastomer compresses to retain the weapon thereto in spite of a discharge of the weapon.

7. Apparatus as set forth in claim 1 wherein the barrel rest means includes elevation adjustment means connected between the base and a V-shaped barrel support having a press fit elastomeric pad for adjusting the height of the barrel relative to the base.

8. Apparatus as set forth in claim 7 including means for adjustably supporting said barrel support along said base.

9. Apparatus as set forth in claim 1 wherein the apparatus further includes means coupled to the base for rotating and leveling the weapon about the longitudinal axis of the barrel.

10. Apparatus as set forth in claim 1 further including locking means for locking the base at a selected angular orientation with respect to the recoil transfer means.

11. Apparatus as set forth in claim 1 further including resilient strap means wrapped about the weapon and base for securely holding the weapon to the base.

12. Apparatus as set forth in claim 1 wherein said barrel support means includes means for slidably coupling said barrel support means in length adjustable relation to said stock support means along said base.

13. Apparatus as set forth in claim 1 wherein said base includes a longitudinal slot which receives said barrel support means and further means for securing said barrel rest means along said slot.

14. Apparatus for adjusting the sights of a weapon having a barrel and a stock comprising:

(a) a base;

(b) barrel support means including means for height adjustably coupling said barrel support means to the base and means for slidably coupling said barrel support means relative to said base;

(c) means for engaging an edge surface of a grounded support and including a vertical axle about which said base is rotationally coupled; and (d) stock receiving means including a curved interior surface conforming to an aft end shape of the stock and a curved outer surface shape conforming to a region or normal physical support by a marksperson.

15. Apparatus as set forth in claim 14 including means coupled to the base for rotating and leveling the weapon about the longitudinal axis of the barrel.

16. Apparatus as set forth in claim 15 including resilient strap means wrapped about the weapon and base for securely holding the weapon to the base.

17. Apparatus as set forth in claim 14 including means for resiliently supporting said barrel support means relative to said base.

18. Apparatus for adjusting the sights of a weapon having a barrel and a stock comprising:

(a) a base;

(b) barrel support means including means for height adjustably and resiliently coupling said barrel support means to the base and means for slidably coupling said barrel support means relative to said base;

(c) a frame member shaped to engage an edge surface of a grounded support and including a vertical axle about which said base is rotationally coupled and means for fixing a determined rotation;

(d) means coupled to the base for rotating and leveling the weapon about the longitudinal axis of the barrel;

(e) resilient strap means wrapped about the weapon and base for securely holding the weapon to the base; and (f) means connected to the base and resting on the grounded support for rotating the weapon about the vertical axle in a plane substantially parallel with the grounded support.

19. Apparatus for adjusting the sights of a weapon having a barrel and a stock comprising:

(a) a base;

(b) means mounted to the base for resiliently supporting the barrel;

(c) stock receiving means mounted to the base and including a housing having bottom, side and end walls and wherein ones of the interior surfaces of the walls are lined with an elastomer, such that upon insertion of a weapon the elastomer compresses to retain the weapon thereto;

(d) resilient strap means wrapped about the weapon and base for securely holding the weapon to the base; and (e) recoil transfer means for absorbing and transferring to a grounded support recoil shock forces acting on the base upon discharge of the weapon, and whereby the weapon remains substantially stationary with each discharge of the weapon.

20. Apparatus as set forth in claim 19 wherein the the end wall of the stock receiving means includes a curved interior surface conforming to the aft end shape of the stock and a curved outer surface shape conforming to a region of normal physical support of the stock by a marksperson.

* * * * *